US008502449B2

(12) United States Patent
Becker et al.

(10) Patent No.: US 8,502,449 B2
(45) Date of Patent: Aug. 6, 2013

(54) HIGH-PRESSURE DISCHARGE LAMP HAVING A SINGLE SOCKET

(75) Inventors: Jürgen Becker, Berlin (DE); Florian Bedynek, Berlin (DE); Kilian Klages, Detmold (DE); Karsten Pietsch, Berlin (DE); Matthias Protsch, Berlin (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/509,223

(22) PCT Filed: Nov. 2, 2010

(86) PCT No.: PCT/EP2010/066637

§ 371 (c)(1),
(2), (4) Date: May 10, 2012

(87) PCT Pub. No.: WO2011/057916

PCT Pub. Date: May 19, 2011

(65) Prior Publication Data

US 2012/0229023 A1 Sep. 13, 2012

(30) Foreign Application Priority Data

Nov. 10, 2009 (DE) ..... 10 2009 052 624

(51) Int. Cl.

| | |
|---|---|
| ***H01J 17/04*** | (2012.01) |
| ***H01J 61/04*** | (2006.01) |
| ***H01J 11/00*** | (2012.01) |
| ***H01J 17/00*** | (2006.01) |

(52) U.S. Cl.
USPC ..... 313/620; 313/567; 313/621

(58) Field of Classification Search
None
See application file for complete search history.

(56) References Cited

U.S. PATENT DOCUMENTS

| | | | | |
|---|---|---|---|---|
| 5,654,608 | A | 8/1997 | Westemeyer et al. | |
| 6,967,444 | B2 * | 11/2005 | Callahan et al. | 313/637 |
| 2005/0168150 | A1 | 8/2005 | Callahan et al. | |

FOREIGN PATENT DOCUMENTS

| | | |
|---|---|---|
| WO | WO 2008/071543 | 6/2008 |

* cited by examiner

*Primary Examiner* — Natalie Walford
(74) *Attorney, Agent, or Firm* — Cozen O'Connor

(57) ABSTRACT

A high-pressure discharge lamp having a single socket, comprising: a discharge vessel (100) having two opposite sealed ends (120, 130) and a discharge chamber (110) arranged between the sealed ends (120, 130), a first sealed end (120) extending into a lamp base (400) and the second sealed end (130) protruding out of the lamp base (400), a first electrode (20) which is fixed in the first sealed end (120) of the discharge vessel (100) and has an end on the discharge side extending into the discharge chamber (110), a second electrode (30) which is fixed in the second sealed end (130) of the discharge vessel (100) and has an end on the discharge side extending into the discharge chamber; and (110), a base flange (420) arranged on the lamp base (400) and defining a plane (421) which is usable for adjusting the high-pressure discharge lamp in an optical system wherein for the distance A from the end of the first electrode (20) on the discharge side to the plane (421) of the base flange (420) and for the distance B from the end of the second electrode (30) on the discharge side to the plane (421) of the base flange (420), the following relation applies:

$$15.0\ \text{mm} \leq \frac{A+B}{2} \leq 27.0\ \text{mm}.$$

9 Claims, 1 Drawing Sheet

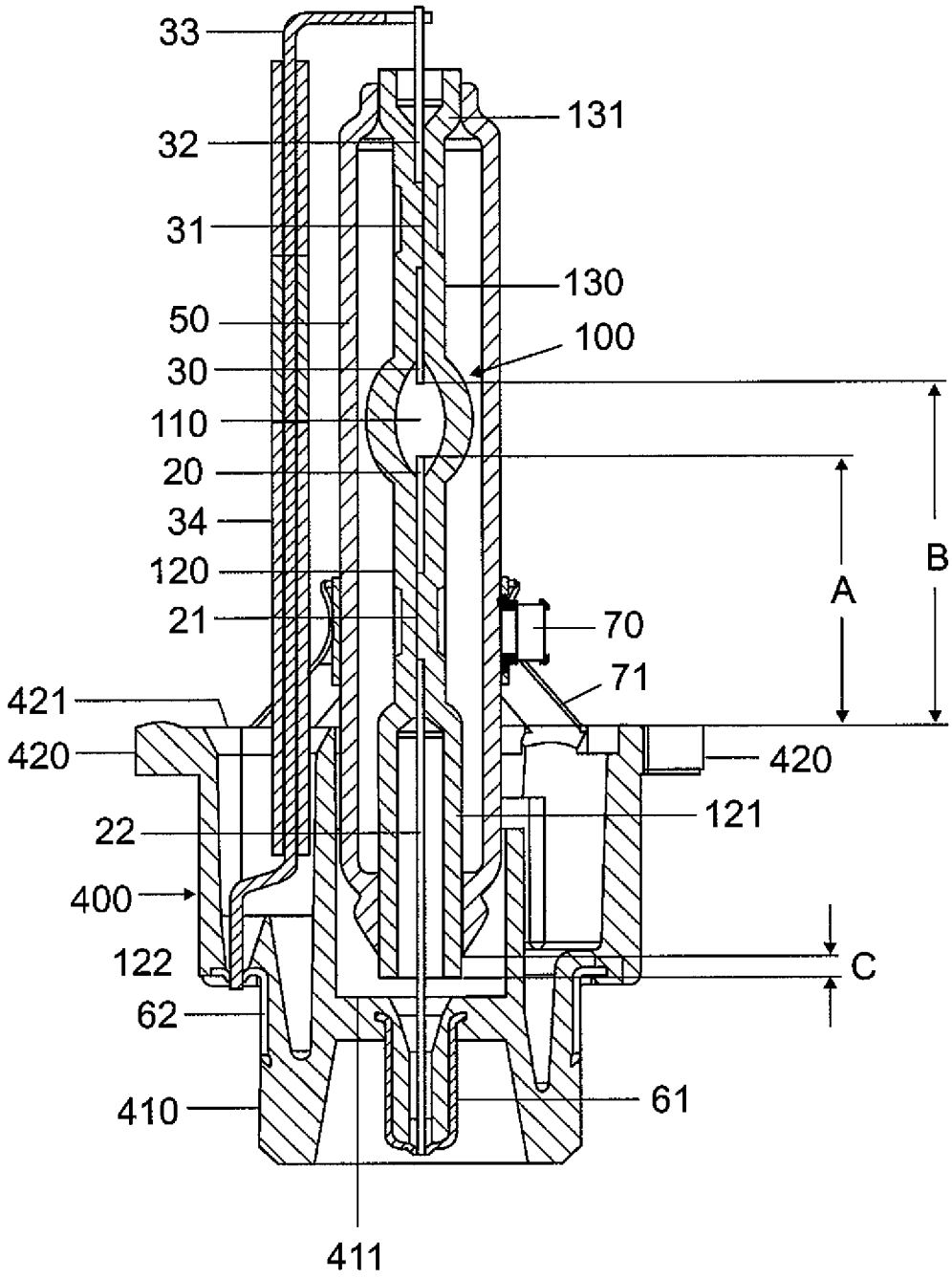
33
32
31
50
30
110
20
34
120
21
421
420
22
400
122
62
410
411
131
130
100
70
71
420
121
61
A
B
C

HIGH-PRESSURE DISCHARGE LAMP HAVING A SINGLE SOCKET

RELATED APPLICATIONS

This application is a U.S. National Phase Application under 35 USC 371 of International Application PCT/EP2010/066637 filed Nov. 2, 2010.

This application claims the priority of German application no. 10 2009 052 624.2 filed Nov. 10, 2009, the entire content of which is hereby incorporated by reference.

FIELD OF THE INVENTION

The present invention relates to a high-pressure discharge lamp having a single socket, such as for a vehicle headlamp.

BACKGROUND OF THE INVENTION

A high-pressure discharge lamp of the type in question is known, for example, from WO 2008/071543 A1. Said document describes a high-pressure discharge lamp having a single socket for a vehicle headlamp, the high-pressure discharge lamp having the following features:

- a discharge vessel having two opposite sealed ends and a discharge chamber arranged between the sealed ends, a first sealed end extending into a lamp base and the second sealed end protruding out of the lamp base,
- a first electrode which is fixed in the first sealed end of the discharge vessel and has an end on the discharge side extending into the discharge chamber,
- a second electrode which is fixed in the second sealed end of the discharge vessel and has an end on the discharge side extending into the discharge chamber, and
- a base flange arranged on the lamp base and defining a plane which is usable for adjusting the high-pressure discharge lamp in an optical system.

SUMMARY OF THE INVENTION

It is an object of the present invention to provide a high-pressure discharge lamp of the type in question which is suitable as a light source for reflectors of flat design and having the same construction as high-pressure discharge lamps of the type in question.

The high-pressure discharge lamp according to one aspect of the invention comprises:

- a discharge vessel having two opposite sealed ends and a discharge chamber arranged between the sealed ends, a first sealed end extending into a lamp base and the second sealed end protruding out of the lamp base,
- a first electrode which is fixed in the first sealed end of the discharge vessel and has an end on the discharge side extending into the discharge chamber,
- a second electrode which is fixed in the second sealed end of the discharge vessel and has an end on the discharge side extending into the discharge chamber, and
- a base flange arranged on the lamp base and defining a plane which is usable for adjusting the high-pressure discharge lamp in an optical system.

The high-pressure discharge lamp according to an embodiment of the invention is characterized in that for the distance A from the end of the first electrode on the discharge side to the plane of the base flange and for the distance B from the end of the second electrode on the discharge side to the plane of the base flange, the following relation applies:

$$15.0\ \text{mm} \leq \frac{A+B}{2} \leq 27.0\ \text{mm}$$

With this electrode arrangement, the high-pressure discharge lamp according to the invention has a low "light center length", that is, a small distance from the center of gravity of the arc to the reference plane of the base flange, which is used for aligning the arc in relation to the vehicle headlamp reflector. In particular, the size (A+B)/2, which serves as a measure of the light center length is less than or equal to 27.0 mm, so that the high-pressure discharge lamp can be used in reflectors of flat design. On the other hand, the size (A+B)/2 is greater than or equal to 15.0 mm, so that conventional technology can be used for the lamp base and the lamp vessel holder of the high-pressure discharge lamp according to the invention. In particular, the same materials can be used for the lamp base and the lamp vessel holder of the inventive high-pressure lamp as are used for high-pressure discharge lamps of the type in question, since under the aforementioned condition, with the size (A+B)/2, excessively high operating temperatures do not arise using the inventive high-pressure discharge lamp. Furthermore, the lower limit for the value of the dimension (A+B)/2 is still sufficiently large to prevent shading effects from a lamp vessel holder arranged in the region of the first sealed end.

Preferably, the sealed ends of the discharge vessel each have a tubular extension in order to fasten the outer envelope surrounding the discharge vessel thereon. The tubular extensions, due to the cylindrical form thereof, enable simple fixing of the outer envelope to the discharge vessel in that the heated and softened outer envelope material is pressed and melted onto the tubular extensions by means of rollers. The outer envelope serves as explosion and splinter protection and for absorbing ultraviolet radiation. For example, for this reason, the outer envelope comprises hard glass or quartz glass which is provided with ultraviolet radiation-absorbing additives, such as titanium oxide and cerium oxide.

Furthermore, the tubular extension of the first sealed end of the discharge vessel and of the outer envelope advantageously extend into the lamp base so that a current feed for the first electrode is surrounded by the tubular extension and the outer envelope, and the length C of a section of the tubular extension of the first sealed end of the discharge vessel extending out of the outer envelope has a value in the range of 1.0 mm to 11.0 mm. This ensures that, firstly, the current feed for the first electrode is electrically insulated against metal parts in the lamp base by means of the aforementioned tubular extension and the outer envelope and, secondly, due to the relatively short section of the tubular extension of the first sealed end of the discharge vessel extending out of the outer envelope in order to achieve the shortest possible light center length, no changes have to be made to the existing manufacturing plant, since the outer envelope, discharge chamber and molybdenum foil seals in the ends of the discharge vessel are identical to the corresponding parts of a conventional high-pressure discharge lamp of the type in question. Therefore, for production of the inventive high-pressure discharge lamps, the production plant for the conventional high-pressure discharge lamps of the type in question can be used.

Advantageously, the distance from the tubular extension of the first sealed end of the discharge vessel extending out of the outer envelope to the lamp base in the longitudinal direction of the discharge vessel is as small as possible, for example, less than or equal to 2 mm, in order to ensure the best possible high voltage insulation of the current feed for the first electrode against the metal parts arranged in the lamp base.

Advantageously, the base flange is made of plastics material, for reasons of manufacturing technology, and preferably of the same plastics material as the lamp base. The lamp base and the base flange can thus be made as plastics injection molded parts in the same production step. Preferably, polyphenylene sulfide and polyether imide are suitable for the lamp base and the base flange.

In the case of the inventive high-pressure discharge lamp, the distance B-A between the ends of the electrodes on the discharge side is in the range of 3.0 mm to 3.9 mm in order to provide a light source which, firstly, approaches as closely as possible, in the embodiment for a vehicle headlamp, to the ideal of a point light source and, secondly, enables sufficient illumination power.

According to the preferred exemplary embodiment of the invention, the high-pressure discharge lamp is configured as a halogen metal vapor high-pressure discharge lamp which contains at least xenon and halides of the metals sodium and scandium in the discharge chamber. The aforementioned filling components of a high-pressure discharge lamp enable the emission of white light immediately following ignition of the gas discharge in the high-pressure discharge lamp, so that the high-pressure discharge lamp is usable as a light source in a vehicle headlamp. Preferably, the inventive high-pressure discharge lamp is configured as a vehicle headlamp which, in semi-stationary operation, that is following ending of the ignition and warm-up phase, has an electrical power consumption in the range of 20 Watt to 35 Watt.

BRIEF DESCRIPTION OF THE SINGLE DRAWING

The drawing shows a cross section through a high-pressure discharge lamp according to an embodiment of the invention.

The drawing shows a mercury-free halogen metal vapor high-pressure discharge lamp with a nominal electrical power rating of 25 Watt. As the discharge medium for the gas discharge, xenon and halides of the metals sodium, scandium, indium and zinc are used.

The lamp has a tubular lamp type of discharge vessel 100 made from quartz glass, having a gas-tight sealed discharge chamber 110, a first sealed end 120 close to the lamp base and a second sealed end 130 remote from the lamp base. Two electrodes 20, 30 protrude into the discharge chamber 110, each being electrically conductively connected, via a molybdenum foil 21, 31 sealed into the sealed end 120, 130 in gas-tight manner, to a current feed 22, 32 leading out of the sealed end 120, 130. The lamp base has a base sleeve 400 comprising a plastics injection-molded part in which the discharge vessel 100 and an outer envelope 50 fused therewith are anchored. The end 410 of the base sleeve 400 facing away from the discharge vessel 100 is configured as a plug with two electrical contacts 61, 62. The central contact 61 is electrically conductively connected to the current feed 22 fed out of the first sealed end 120 close to the lamp base, whereas the other, annular electrical contact 62 is electrically conductively connected via a return 33 surrounded by a ceramic tube 34 to the current feed 32 extending out of the second sealed end 130 of the discharge vessel 100 remote from the lamp base. The discharge vessel 100 is surrounded by a cylindrical outer envelope 50, arranged almost coaxially with the discharge vessel 100. The outer envelope 50 is fused with a tubular extension 131 of the second sealed end 130 remote from the lamp base and with a tubular extension 121 of the first sealed end 120 of the discharge vessel 100 close to the lamp base and extending into the base sleeve 400. The tubular extensions 121, 131 are cylindrically configured. In order to anchor the two lamp vessels 100 and 50 in the cylindrical base sleeve 400, an annular holder element 70, which surrounds the outer envelope 50 with clamping engagement and four bent metal straps 71, the first end of which is welded to the holding element 70, in each case, and the second end of which is anchored in the plastics material of the base sleeve 400, in each case. The base sleeve 400 has, at the end thereof facing away from the electrical contacts, an annular flange 420 with an end face 421 which is arranged perpendicular to the longitudinal axis of the high-pressure discharge lamp and serves as a reference plane for orienting the lamp in the headlamp. At this end face, the base sleeve 400 has an increased wall thickness. In this region, the second ends of the metal straps 71 are anchored in the wall of the base sleeve 400 at the inner side thereof.

The distance A from the end on the discharge side of the first electrode 20 close to the lamp base to the end face 421 is 17.1 mm. The distance B from the end on the discharge side of the second electrode 30 remote from the lamp base to the end face 421 is 20.6 mm. The light center length (A+B)/2 is therefore 18.85 mm. The distance B-A between the ends of the electrodes 20, 30 on the discharge side is 3.5 mm. The optically effective distance between the ends of the electrodes 20, 30 on the discharge side depends on the refractive index and the curvature of the wall of the discharge vessel 100 in the region of the discharge chamber 103 and is in the range of 3.6 mm to 4.2 mm. The length C of the section extending out of the outer envelope 50 of the tubular extension of the first sealed end 101 of the discharge vessel 100 close to the lamp base is 1.0 mm. The distance from the section 122 extending out of the outer envelope 50 of the tubular extension 121 of the first sealed end 120 of the discharge vessel 100 close to the lamp base to the base 411 of the base sleeve 400 is 1.0 mm.

The invention is not restricted to the exemplary embodiment of the invention described in detail above. For example, the invention can also be applied to high-pressure discharge lamps having a single socket in the lamp base of which components of a ballast device for igniting the gas discharge in the high-pressure discharge lamp, or components or an operating device or circuit arrangement for operating the high-pressure discharge lamp are arranged.

The invention claimed is:

1. A high-pressure discharge lamp having a single socket, comprising:

a discharge vessel having two opposite sealed ends and a discharge chamber arranged between the sealed ends, a first sealed end extending into a lamp base and the second sealed end protruding out of the lamp base;

a first electrode which is fixed in the first sealed end of the discharge vessel and has an end on the discharge side extending into the discharge chamber;

a second electrode which is fixed in the second sealed end of the discharge vessel and has an end on the discharge side extending into the discharge chamber; and a base flange arranged on the lamp base and defining a plane which is usable for adjusting the high-pressure discharge lamp in an optical system, wherein for the distance A from the end of the first electrode on the discharge side to the plane of the base flange and for the distance B from the end of the second electrode on the discharge side to the plane of the base flange, the following relation applies:

$$15.0\ \text{mm} \leq \frac{A+B}{2} \leq 27.0\ \text{mm}.$$

2. The high-pressure discharge lamp having a single socket as claimed in claim 1, the sealed ends each having a tubular extension and an outer envelope surrounding the discharge vessel being fixed to the tubular extensions.

3. The high-pressure discharge lamp having a single socket as claimed in claim 2, the tubular extension of the first sealed end and of the outer envelope advantageously extending into the lamp base so that a first current feed for the first electrode is surrounded by the tubular extension and the outer envelope, wherein the length C of a section of the tubular extension of the first sealed end extending out of the outer envelope has a value in the range of 1.0 mm to 11.0 mm.

4. The high-pressure discharge lamp having a single socket as claimed in claim 1, wherein the base flange is made of plastics material.

5. The high-pressure discharge lamp having a single socket as claimed in claim 1, wherein the lamp base is made of plastics material.

6. The high-pressure discharge lamp having a single socket as claimed in claim 1, wherein the distance B-A between the ends of the electrodes on the discharge side is in the range of 3.2 mm to 3.8 mm.

7. The high-pressure discharge lamp having a single socket as claimed in claim 1, wherein the optical distance between the ends of the electrodes on the discharge side is in the range of 3.6 mm to 4.2 mm.

8. The high-pressure discharge lamp having a single socket as claimed in claim 1, wherein the high-pressure discharge lamp is a high-pressure halogen metal vapor discharge lamp which contains at least xenon and a halide of sodium and scandium in the discharge chamber.

9. The high-pressure discharge lamp having a single socket as claimed in claim 1, configured as a vehicle headlamp having an electrical power consumption in the range of 20 Watt to 35 Watt.

* * * * *